US006408657B2

(12) United States Patent
Sangiacomo

(10) Patent No.: US 6,408,657 B2
(45) Date of Patent: Jun. 25, 2002

(54) METHOD FOR SELECTING THE NEEDLES IN CIRCULAR STOCKING KNITTING MACHINES AND KNITTING MACHINES, AND MACHINE FOR CARRYING OUT THE METHOD

(75) Inventor: Fulvio Sangiacomo, Brescia (IT)

(73) Assignee: Sangiacomo S.p.A. (IT)

( * ) Notice: Subject to any disclaimer, the term of this patent is extended or adjusted under 35 U.S.C. 154(b) by 0 days.

(21) Appl. No.: 09/783,882

(22) Filed: Feb. 15, 2001

(30) Foreign Application Priority Data

Feb. 29, 2000 (IT) ..... BS00A0015

(51) Int. Cl.[7] ..... D04B 9/00
(52) U.S. Cl. ..... 66/216
(58) Field of Search ..... 66/216, 218, 219, 66/220, 222, 230

(56) References Cited

U.S. PATENT DOCUMENTS 4,879,884 A * 11/1989 Bertagnoli ..... 66/222
5,072,603 A * 12/1991 Tenconi ..... 66/222
5,168,730 A * 12/1992 Conti ..... 66/222
5,184,485 A * 2/1993 Bini ..... 66/216
5,323,627 A * 6/1994 Lonati et al. ..... 66/222
5,367,893 A * 11/1994 Fucik ..... 66/216

* cited by examiner

*Primary Examiner*—Danny Worrell
(74) *Attorney, Agent, or Firm*—McGlew and Tuttle, P.C.

(57) ABSTRACT

A method for selecting the needles in the production of a held stitch and a dropped stitch on circular stocking knitting machines, knitting machines and the like with one or more feed stations and selection units which operate the needles by use of jacks. The method includes prearranging two consecutive selection units (15, 16) in the feed station or in each feed station and using, starting from a condition of preventive extraction of all jacks with the respective needles lowered, one selection unit to control the needles that must knit the held stitch and the other selection unit to control the needles that must knit the dropped stitch.

7 Claims, 1 Drawing Sheet

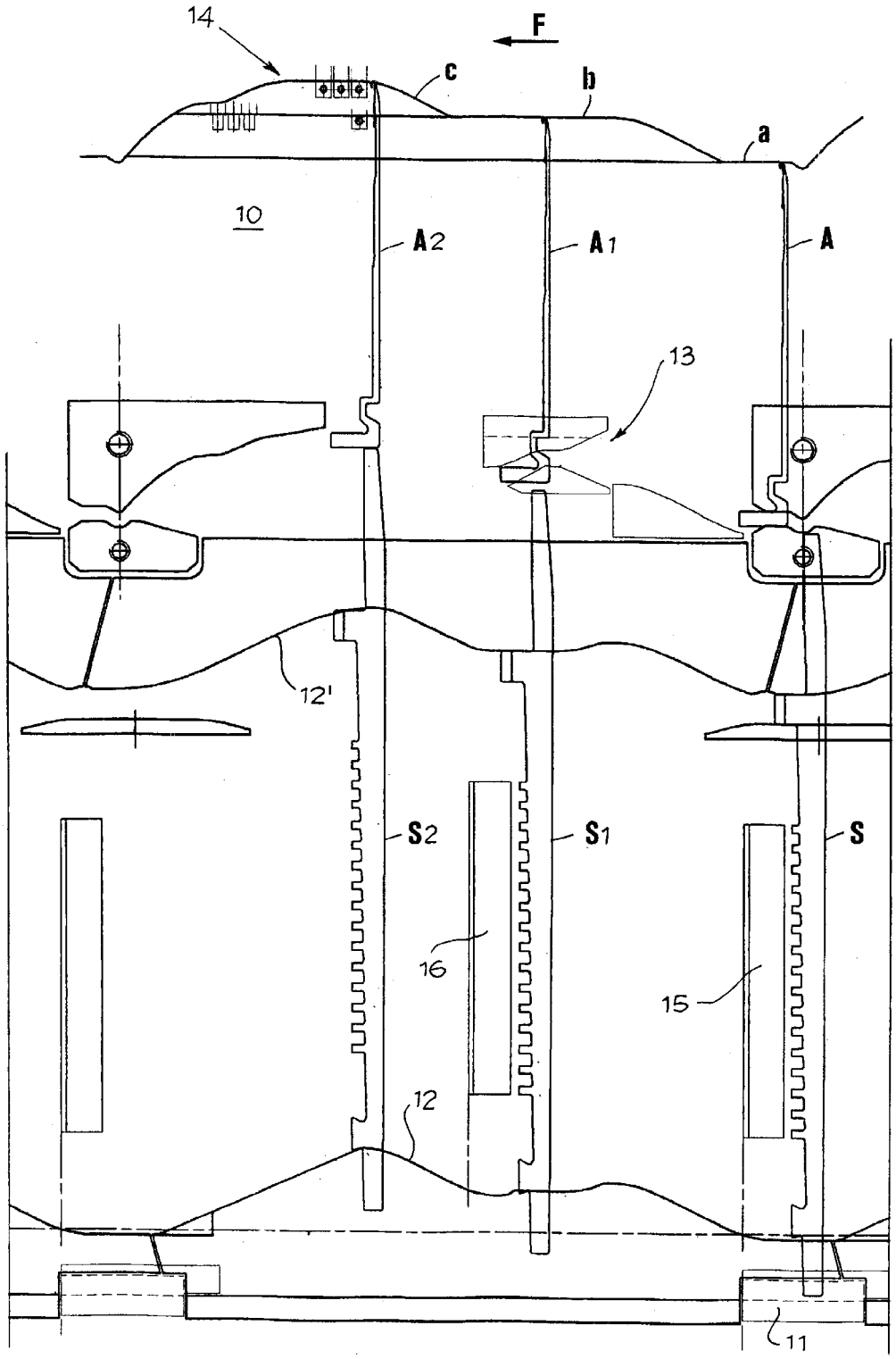
14
F
c
b
a
10
A2
A1
A
13
12'
S2
S1
S
16
15
12
11

METHOD FOR SELECTING THE NEEDLES IN CIRCULAR STOCKING KNITTING MACHINES AND KNITTING MACHINES, AND MACHINE FOR CARRYING OUT THE METHOD

FIELD OF THE INVENTION

The present invention pertains to the field of circular knitting machines and, in particular, it pertains to a method for an operative selection of the needles of circular stocking knitting machines, knitting machines and the like for knitting held and dropped stitches.

BACKGROUND OF THE INVENTION

In general, circular stocking knitting and knitting machines have, around the cylinder which carries the needles for knitting the starting yarns, one or more stations for feeding the yarns and for forming the stitch and a selection unit for operatively controlling the needles. These needles, depending on the knitting process to be carried out, can be controlled, i.e., selected, to individually follow different courses, also called technical paths, of ascending and descending at different levels. Correspondingly, each needle must be able to follow a low course without picking up any yarn fed in, an ascending course that carries it to an intermediate holding level for holding the stitch that was previously knit, and for picking up the yarn, or a higher ascending course in order to reach a level of dropping the respective stitch and picking up new yarn. In other words, depending on the knitting to be carried out, the needles may be induced to follow three technical paths, at a low level, an intermediate level or a high level, respectively. However, with the presence, as currently occurs, of a single unit for selecting the needles in the feed station or in each of the feed stations of a circular stocking knitting machine and the like, the needles can be controlled in each feed station to selectively follow, at the same time, only two of the three technical paths provided for the production of held and dropped stitches.

In fact, a single selection unit does not make it possible to raise the needles that must pass by low without picking up the yarn and to raise the needles that must drop the stitch at the higher level of dropping and picking up new yarn.

Therefore, as in the manufacture of held and dropped stitches, it is evident with the current systems that the selection unit of consecutive feed stations must be engaged with the not indifferent drawback of cutting in half the productive potentials of the circular knitting machines.

SUMMARY AND OBJECTS OF THE INVENTION

The primary object of the present invention is to eliminate this drawback by creating conditions that make possible a production of held and dropped stitches on each feed station of a circular stocking knitting machine, knitting machine and the like for a full exploitation of the productive potential of same, whereas the productive potential was cut in half as explained above in relation to the prior art.

The object of the present invention is accomplished by prearranging two selection units in each feed station of the machine and by using one selection unit to control the needles that must knit a held stitch and the other selection unit to control the needles that must knit a dropped stitch.

The present invention will be better described in the description below and with reference to the attached drawing, in which the sole figure schematically shows the cams and the two selection units corresponding to a feed station of a circular stocking knitting machine, knitting machine or the like.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE is a schematic view showing the cams and the two selection units corresponding to a feed station of a circular stocking knitting machine, knitting machine or the like.

DESCRIPTION OF THE PREFERRED EMBODIMENT

Referring to the drawings in particular, the invention comprises a method for selecting the needles in the production of a held stitch and a dropped stitch on circular stocking knitting machines, knitting machines and the like. The terms "extract" or "extraction" are used below to mean that a needle A is selected and is arranged in an active position to knit, while the term "cancel" means arranging a needle in an inactive position, i.e., of not knitting. The selection and the control of the needles is performed by means of corresponding jacks S.

In the drawing, a feed station, e.g., of a circular knitting machine, which may have one, two or more feed stations, is generally designated 10.

The feed stations or each feed station 10 comprises: a cam 11 for extracting all the jacks; cams 12, 12' for the ascending and descending motion of the jacks; cams 13 for the ascending and descending motion of the needles, which are, however, stopped in an inactive position, and yarn guides 14 for the yarns to be fed to the needles.

In the same feed station 10, at the level of the jacks, two selection units 15 and 16 are included, one following the other in the direction F of rotation of the machine. Moreover, the low course of the needles that must not pick up yarn is indicated by a, the intermediate course of holding and picking up yarn is indicated by b, and the high course of dropping stitches and picking up yarn is indicated by c.

With such an arrangement, the extraction cam 11 initially extracts all the jacks, thus placing them in a position for being able to be selected corresponding to the selection units 15 and 16 and for correspondingly controlling the respective needles.

Once all the jacks have been extracted, the selection unit 15 is prearranged to cancel the jacks S of the needles A that must follow the low course a without picking up yarn and to make a selection of the remaining jacks and respective, uncanceled needles.

In practice, the jacks S1 and, with them, the uncanceled needles A1 follow the intermediate course b of holding, and then meeting the other selection unit 16. By means of the jacks S2, this unit 16 selects the needles, canceling those that must knit the held stitch and leaving the jacks S2 and the corresponding, remaining needles A2 to follow the course c of dropping, being raised by the dropping cam.

Therefore, it is evident how, by arranging two selection units 15, 16 within the framework of a same feed station of a circular stocking knitting machine, knitting machine and the like, it is possible to knit held and dropped stitches without involving any successive feed station and how, in other words, it is possible to produce held and dropped stitches in the same way at the same time on all the feed stations of a circular machine, thus fully exploiting the productive potentials thereof While specific embodiments of the invention have been shown and described in detail to illustrate the application of the principles of the invention, it will be understood that the invention may be embodied otherwise without departing from such principles.

What is claimed is:

1. A circular knitting machine, comprising:

a plurality of needles forming a cylinder;

jacks; and a feed station having a feed station needle selection region, the feed station including an extraction element for extracting all jacks at a beginning of said needle selection region to place all jacks in a position for selection, a first selection unit disposed at a location of said needle selection region beyond said extraction element with respect to a feed direction of said feed station, said first selection unit for canceling jacks or selecting jacks to carry needles to a needle position for making a held stitch, and a second selection unit disposed at a location of said needle selection region beyond said first selection unit with respect to the feed direction of said feed station, said second selection unit canceling jacks to maintain the needle position for making a held stitch and for selecting jacks to carry needles to a needle position for making a dropped stitch.

2. A circular knitting machine according to claim 1, wherein said extraction element is an extraction cam and only one extraction cam is provided as part of said feed station.

3. A circular knitting machine according to claim 2, wherein said extraction cam extracts all jacks to provide needles in a lowered inactive position.

4. A method for selecting needles in a production of a held stitch and a dropped stitch on a circular stocking knitting machine with a feed station, the method comprising the steps of prearranging a first selection unit and a second selection unit as two consecutive selection units in a feed region of the feed station, each of the selection units performing positioning operations on the needles using jacks;

extracting all the jacks to provide lowered needles at a beginning of the feed region, with respect to a feed direction;

using the first selection unit to provide for canceling and inactivating each needle that must remain lowered without picking up yarn and leaving remaining needles to follow an intermediate course for the formation of a held stitch;

using the second selection unit for canceling the needles that knit a held stitch so as to follow the intermediate course for the formation of a held stitch and leaving remaining uncanceled needles to follow a dropping course defined by an ascending cam.

5. A method according to claim 4, wherein said step of extracting uses an extraction cam with only one extraction cam provided as part of said feed station.

6. A method according to claim 5, wherein all jacks are extracted by the extraction cam to provide needles in a lowered inactive position.

7. A circular knitting machine, comprising:

a plurality of needles forming a cylinder;

jacks; and a feed station having a feed station needle selection region, the feed station including an extraction element for extracting all jacks at a beginning of said needle selection region to place all jacks in a position for selection, an ascending cam defining a dropping course, a first selection unit disposed at a location of said needle selection region beyond said extraction element with respect to a feed direction of said feed station, said first selection unit for canceling jacks or selecting jacks to carry needles to a needle position for making a held stitch, and a second selection unit disposed at a location of said needle selection region beyond said first selection unit with respect to the feed direction of said feed station, said second selection unit canceling jacks to maintain the needle position for making a held stitch and for selecting jacks to follow said ascending cam to carry needles to a needle position for making a dropped stitch.

* * * * *